US007770262B2

(12) United States Patent
Schultz et al.

(10) Patent No.: US 7,770,262 B2
(45) Date of Patent: Aug. 10, 2010

(54) CUSHION GRIP HANDLE

(75) Inventors: William H. Schultz, Northbrook, IL (US); Louis J. Vassos, Chicago, IL (US)

(73) Assignee: Robert Bosch Tool Corporation, Broadview, IL (US)

( * ) Notice: Subject to any disclaimer, the term of this patent is extended or adjusted under 35 U.S.C. 154(b) by 45 days.

(21) Appl. No.: 10/440,857

(22) Filed: May 19, 2003

(65) Prior Publication Data

US 2004/0231100 A1 Nov. 25, 2004

(51) Int. Cl.
*B25G 1/10* (2006.01)
*B25G 1/00* (2006.01)

(52) U.S. Cl. ..... 16/430; 16/110.1; 16/431; 16/421

(58) Field of Classification Search ..... 16/110.1, 16/430, 421, 431, DIG. 12, DIG. 18, DIG. 19; 81/489–492, 22, 177.1, 177.3; 473/300
See application file for complete search history.

(56) References Cited

U.S. PATENT DOCUMENTS 604,706 A * 5/1898 Wiens et al. ..... 74/551.9
3,185,001 A * 5/1965 Viator ..... 81/177.1
3,189,069 A * 6/1965 Stowell ..... 16/421
3,340,914 A * 9/1967 Ricks ..... 81/177.1
3,565,351 A * 2/1971 Ross et al. ..... 241/99
4,331,193 A 5/1982 Tudisco et al.
4,347,648 A * 9/1982 Dekkers ..... 24/16 PB
4,721,021 A * 1/1988 Kusznir ..... 81/22
4,738,166 A * 4/1988 Yamaguchi ..... 81/22
4,739,536 A 4/1988 Bandera et al.
4,768,406 A * 9/1988 Fitzwater ..... 81/177.1
4,837,892 A 6/1989 Lo
4,969,231 A * 11/1990 Mader et al. ..... 16/421
5,099,724 A * 3/1992 Reddy, Jr. ..... 81/20
5,211,085 A * 5/1993 Liou ..... 81/20
5,280,739 A * 1/1994 Liou ..... 81/22
5,339,482 A * 8/1994 Desimone et al. ..... 16/DIG. 19
5,530,989 A 7/1996 Remmert et al.
5,581,845 A * 12/1996 Yang ..... 16/421

(Continued)

FOREIGN PATENT DOCUMENTS

EP 0 005 635 11/1979

(Continued)

*Primary Examiner*—Victor Batson
*Assistant Examiner*—Jeffrey O'Brien
(74) *Attorney, Agent, or Firm*—Greer, Burns & Crain, Ltd.

(57) ABSTRACT

Handle portions of hand tools are disclosed that enhance gripping properties while simultaneously imparting flexibility and cushioning properties to the tool handle portion to promote a softer, more ergonomic tool handle portion. The handle portion of a hand tool housing is ergonomically configured for normal gripping by a user's hand and wherein the pressure points of contact by at least one predetermined portion of the hand principally contact a relatively soft tactile cushion surface. The handle portion has at least one support structure configured to provide a volume around which the user's hand can grip with the user's thumb, palm and fingers in contact with said volume, wherein the support structure has at least one window located adjacent the predetermined portion, and a cushion structure bonded to the support structure and spanning each window to provide the relatively soft tactile cushion surface.

20 Claims, 11 Drawing Sheets

U.S. PATENT DOCUMENTS 5,740,586 A 4/1998 Gomas
5,752,287 A * 5/1998 Wheat ..... 15/176.2
5,781,956 A * 7/1998 Kelsay et al. ..... 16/430
5,799,369 A * 9/1998 Schulein ..... 16/430
5,911,798 A * 6/1999 Arnold ..... 81/177.2
6,024,903 A 2/2000 Naft et al.
6,101,895 A * 8/2000 Yamane ..... 74/551.9
6,108,869 A * 8/2000 Meessmann et al. ..... 16/430
6,161,256 A 12/2000 Quiring et al.
6,170,123 B1 1/2001 Holland-Letz
6,199,460 B1 * 3/2001 Lo ..... 81/489
6,220,128 B1 * 4/2001 Hu ..... 81/489
6,223,627 B1 * 5/2001 Jan et al. ..... 81/22
6,230,366 B1 * 5/2001 Lin ..... 16/431
6,305,815 B1 * 10/2001 Lin ..... 362/119
6,308,378 B1 10/2001 Mooty et al.
6,401,290 B1 * 6/2002 Barton et al. ..... 15/143.1
6,405,619 B1 * 6/2002 Lamond et al. ..... 81/177.1
6,408,524 B1 * 6/2002 Lai ..... 30/324
6,513,198 B2 * 2/2003 Lu ..... 16/431
6,604,256 B1 * 8/2003 Pytlewski ..... 15/235.4
6,619,408 B1 * 9/2003 Lai ..... 173/90
6,629,338 B2 * 10/2003 Dierolf et al. ..... 16/430
6,662,406 B2 * 12/2003 Shonfeld et al. ..... 16/431
6,721,997 B2 * 4/2004 Hua ..... 16/431
6,742,215 B2 * 6/2004 Panfili et al. ..... 15/236.01
6,772,994 B1 * 8/2004 Lawless ..... 254/25
6,776,073 B1 * 8/2004 Brady et al. ..... 81/427.5
6,779,235 B2 * 8/2004 Newman et al. ..... 16/DIG. 19
2002/0194706 A1 12/2002 Lu
2003/0233734 A1 * 12/2003 McGuyer et al. ..... 16/430

FOREIGN PATENT DOCUMENTS

GB 2147242 A * 5/1985
WO WO 00/09296 2/2000

* cited by examiner

CUSHION GRIP HANDLE

BACKGROUND OF THE INVENTION

The present invention generally relates to handles for use with devices intended to be grasped in a user's hand, and more particularly to a handle portion of a hand tool.

There has been continued innovation and improvement in the design of tool handles, particularly with regard to the tactile properties of tool handles. Examples of such tool handles are those produced under the Bosch®, Skil® or Dremel® brands by the Robert Bosch Tool Corporation of Chicago, Ill. The tool handles are generally cylindrical or elliptical in shape and have a plurality of grooves to promote comfortable ergonomic grasping by a user's hand.

The configuration of tool handles and the manner in which they are manufactured has been the subject of continuing efforts for decades to provide a simple and effective tool handle that enhances gripping properties while simultaneously imparting cushioning properties to the tool handle to promote a softer, more ergonomic tool handle.

SUMMARY OF THE INVENTION

The present invention is related to handle portions of hand tools that enhance gripping properties while simultaneously imparting flexibility and cushioning properties to the tool handle portion to promote a softer, more ergonomic tool handle portion.

DETAILED DESCRIPTION OF THE INVENTION

Typically, tool handles such as those disposed on conventional drills, drywall screwdrivers, circular saws or sanders, to name a few, include a generally cylindrical or elliptical body around which a user wraps his fingers to grasp and operate the tool. To enhance the user's ability to more firmly grasp the tool, conventional grips for tool handles frequently include a configuration having a plurality of depressions or grooves that help prevent slippage of the user's fingers during use.

Additionally, tool handles are often manufactured to include two composite structures: a hard base material and a softer grip material that is bonded thereto. An example of such a tool handle is the hammer drill produced under the Bosch® brand by the Robert Bosch Tool Corporation of Chicago, Ill. First a base is formed, typically of nylon or urethane, wherein the base is a generally elliptical tube having a plurality of depressions. Next, a softer grip material is injected into the depressions. For example, the softer grip material may be a thermal plastic elastomer such as urethane or Santoprene®, which is manufactured by Advanced Elastomer Systems in Akron, Ohio. Thus, the depressions within the nylon base serve as basins for receiving the thermal plastic elastomer. However, because the thermal plastic elastomer is confined at a bottom surface opposite the gripping surface, there is limited flexibility as the thermal plastic elastomer is compressed into the bottom surface of the nylon base.

Figure 11:
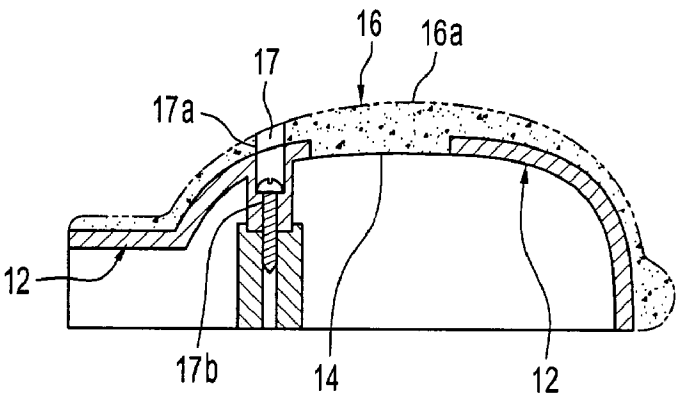
FIG. 11 is a cross-sectional view of the tool cap portion illustrated in FIG. 10.
Figure 12:
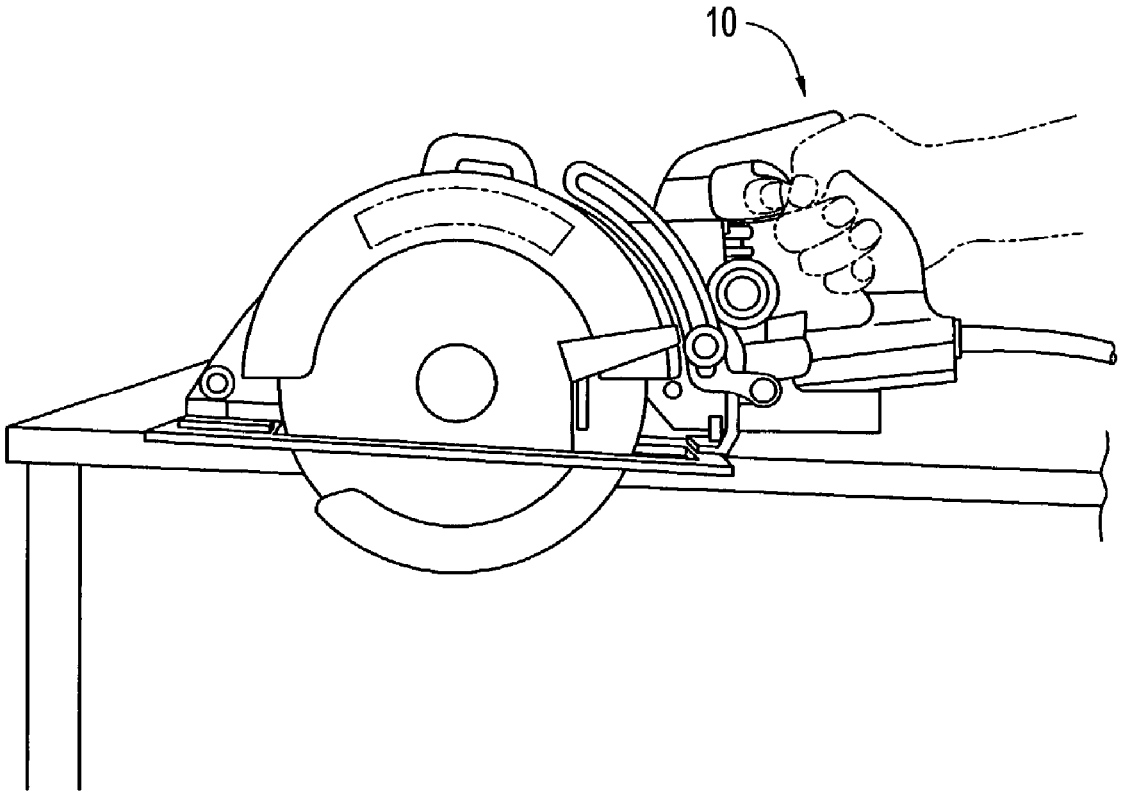
FIG. 12 is a side elevational view of a user's hand gripping the tool handle portion of the instant invention as the tool handle portion is assembled to a circular saw.
Figure 13:
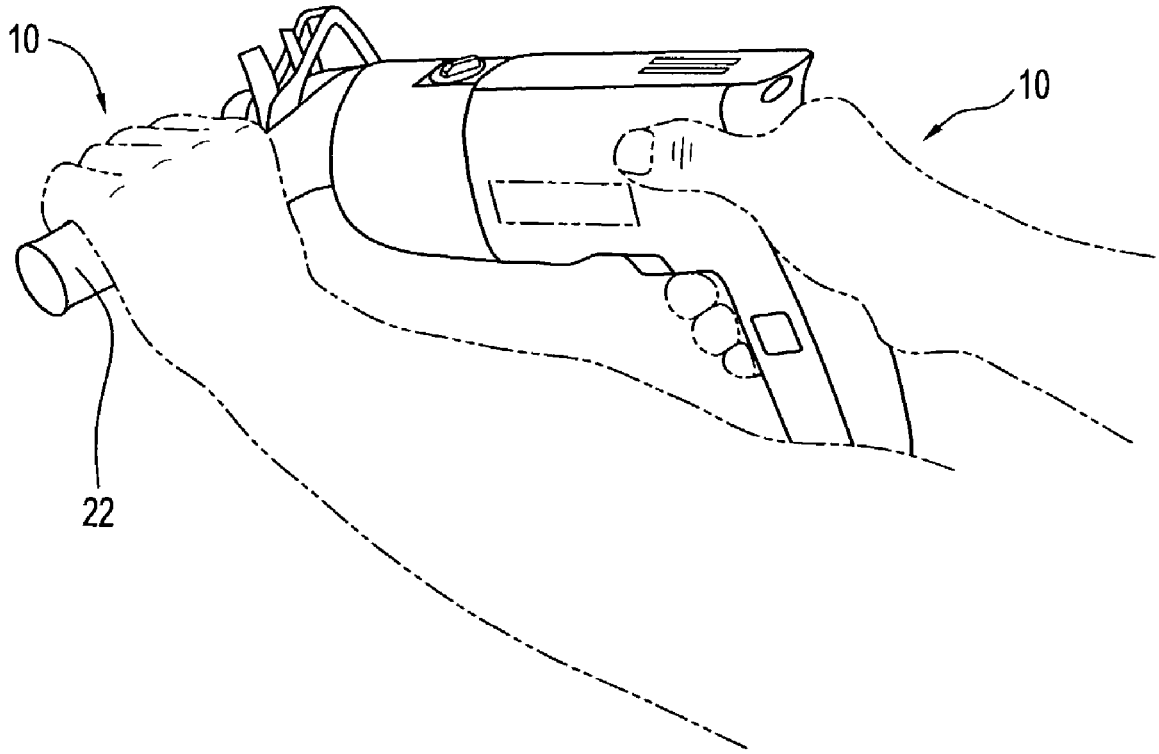
FIG. 13 is a side elevational view of a user's hand gripping the tool handle portion of the instant invention as the tool handle portion is assembled to a hammer drill.
Figure 14:
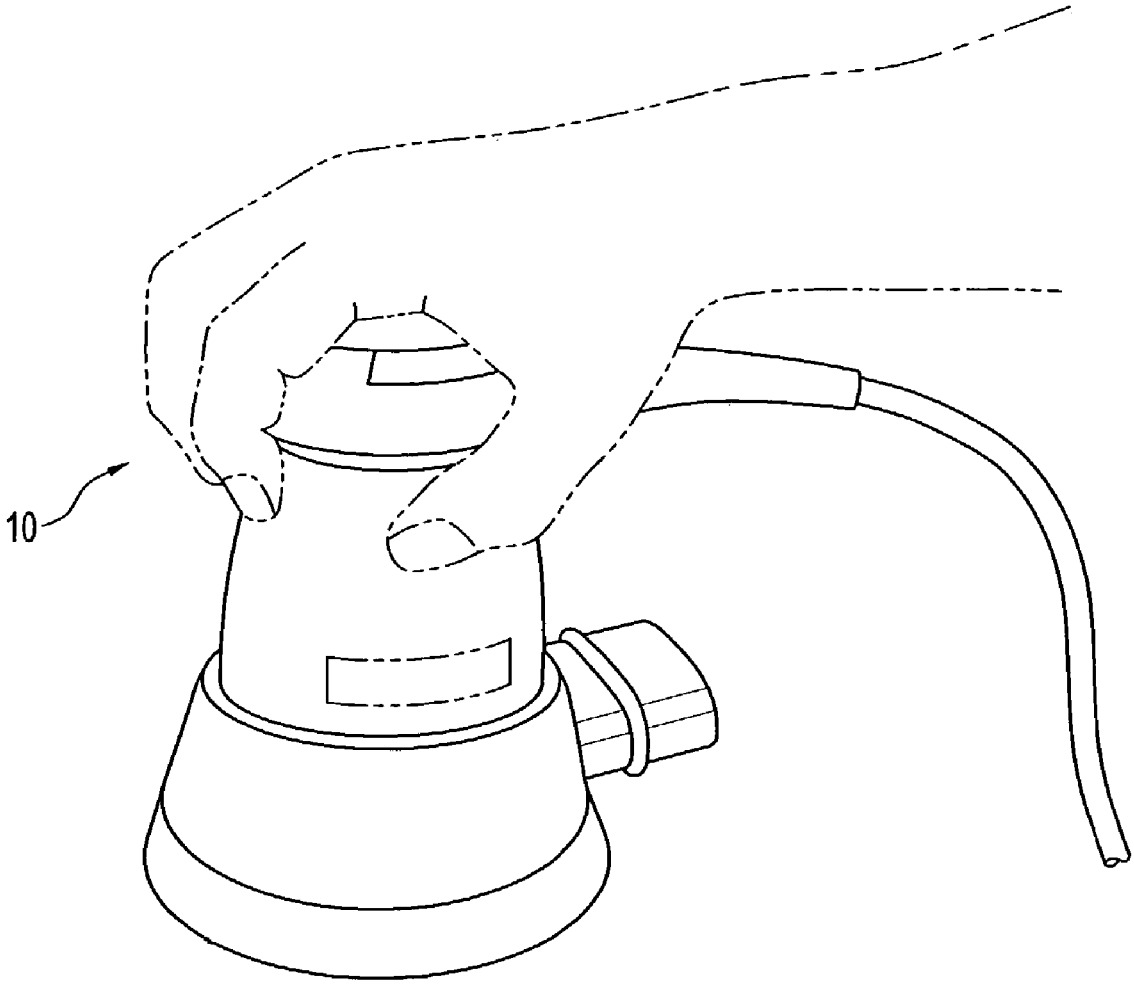
FIG. 14 is a side elevational view of a user's hand gripping the tool handle portion of the instant invention as the tool handle portion is assembled to a sander.

Turning now to FIGS. 1-11, the handle portion of the preferred embodiment of the present invention, designated generally at 10, includes a skeletal support structure 12 having at least one window 14 therethrough and a cushion structure 16, at least part of which is disposed within the one window. While it is contemplated that the handle portion of the present invention may be incorporated into a multitude of devices that are intended to be grasped by a user's hand, for purposes of illustration, the instant handle portion will be shown in connection with hand tools, such as a circular saw, a hammer drill and a sander, as illustrated in FIGS. 12-14, respectively.

The support structure 12 is comprised of a relatively rigid material, such as nylon, rubber or urethane, and is configured to provide a volume around which the user's hand can grip with the user's thumb, palm and fingers in contact with cushion structure 16 surrounding the volume. By using a relatively rigid material, the support structure 12 imparts structural strength to the handle portion 10. While the support structure 12 assumes a predetermined configuration, the predetermined configuration may vary to suit individual applications. However, in general, the support structure 12 preferably includes a generally elliptical body 18 having a top surface 20, a bottom surface 21 and the at least one window 14. Alternatively, the body 18 may have a generally cylindrical shape, such as side handle 22 of the hammer drill illustrated in FIG. 13. Often the support structure includes a plurality of windows having a predetermined size and configuration and that are separated by ribs 23 also having a predetermined size and configuration.

Unlike the prior art, the windows 14 of the instant invention completely penetrate a depth of the body 18 so that the windows lack bottom surfaces, thus being open to a center of the handle portion 10. Thus, when the cushion structure 16 is bonded thereto, the support structure 12 acts as a skeletal scaffold for the handle portion 10.

Like the support structure 12, the predetermined size and configuration of the cushion structure 16 varies to suit individual applications. The cushion structure 16 is composed of an elastic substance, typically a thermal plastic elastomer such as Santoprene® or urethane, so that the cushion structure imparts flexibility and cushioning properties to the handle portion 10. The composite material of the cushion structure 16 may vary insofar as the composite material of the support structure 12 and the composite material of the cushion structure have adhesive properties that allow chemical bonding between the two structures.

For example, one ideal material is obtained via a process used by Trostel, Ltd., wherein urethane is injected into a mold, thereby forming a cushion layer having an outer surface layer that is typically smooth but may be textured, while inner layers form a microcellular material that foams underneath the outer surface. The foamed inner surface creates a soft cushion material that may be included in the cushion structure 16 of the various embodiments of the present invention.

The thickness of the cushion structure 16 may vary, thereby imparting relatively more or less flexibility to the handle portion 10. The cushion structure 16 of the present tool handle portion 10 contemplates varying thicknesses to suit individual applications, but preferably includes a cushion structure 16 having a thickness from between 2 mm and 25 mm. Additionally, the cushion structure 16 may not have a uniform thickness throughout, but may include local maximum and minimum thickness values. For example, the cushion structure 16 may be formed to have an arched cross section, which may result in a cushion structure that is thicker at predetermined radii when measured from a longitudinal axis of the tool handle portion 10. FIG. 11 illustrates an arched cushion structure 16 wherein a center region 16*a* is thicker than the remainder of the cushion structure.

Figure 10:
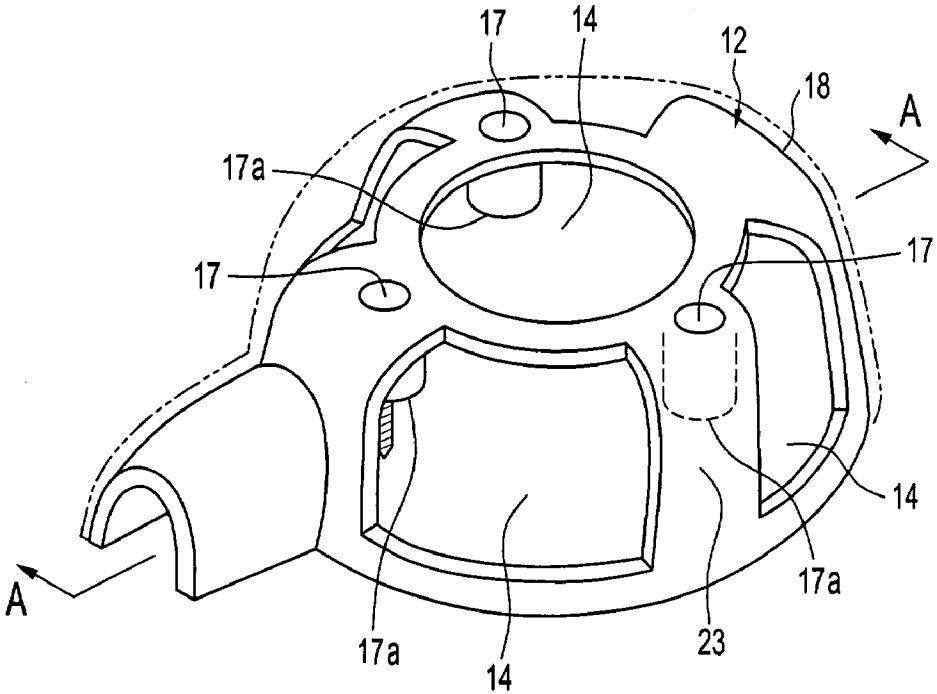
FIG. 10 is a top perspective view of the support structure of the tool cap portion of the instant invention.

As illustrated in FIGS. 10 and 11, at least one orifice 17 having a generally hollow enlongated shaft 17*a* depending therefrom preferably extends through the cushion structure 16. The elongated shaft 17*a* is configured to align with a portion of the handle tool and to receive a threaded fastener 17*b* that maintains secure engagement of the tool handle portion with the hand tool with which the tool handle portion operates.

Just as the thickness may vary, the configuration of the cushion structure 16 may also vary, though it has a predetermined configuration that generally compliments the predetermined configuration of the support structure 12. The cushion structure 16 may be configured to promote flexibility and cushioning properties by changing the thickness of the cushion structure or increasing or decreasing the size of the support structure 12 underlying the cushion structure. This will increase or decrease the relative flexibility and cushioning properties of the handle portion 10.

Thus, in operation, a manufacturer would first determine the locations on the handle portion 10 where flexibility is desired, and the degree of flexibility that is desired at those locations. Typically, the locations on the handle portion 10 wherein cushion and flexibility would be desired are those locations where the user's hand will contact the handle portion with his thumb, palm and fingers. The handle portion 10 is then manufactured accordingly using an injection molding process that is known in the art. Preferably, the handle portion 10 is injected molded through a two-shot process, with the support structure 12 being formed with a first shot and the cushion structure 16 being formed with a second shot.

As those skilled in the art will appreciate, tool handles are frequently manufactured by forming two separate handle halves, and then coupling the handle halves to one another via snap-fit or other mating engagement. Therefore, the instant invention may preferably include multiple molds for creating separate halves of the handle portion 10 that will ultimately be assembled to one another to form a single handle portion. Using a mold or molds having a predetermined configuration, the support structure 12 is formed to have a corresponding predetermined configuration and a predetermined number of windows 14. Subsequently, a second mold is used to inject the cushion structure 16 over the support structure 12. In this manner, the cushion structure 16 is formed over an external surface of the support structure 12 and within the windows 14 of the support structure to be complimentary with the support structure. Depending on the degree of flexibility desired by the manufacturer, as well as aesthetic and tactile considerations, the cushion structure 16 may be confined to the windows 14 of the support structure 12 leaving the support structure exposed, or may overlay and obscure the support structure. Thus, when finished, the support structure 12 may not be visible underneath the cushion structure 16.

Together with varying the configuration of the cushion structure 16, varying the configuration of the support structure 12 will increase or decrease flexibility of the cushion structure. Ultimately, an inverse relationship emerges between the cushion structure 16 and the support structure 12. For example, if numerous windows 14 are provided in the support structure 12, the support structure will be more porous, dedicating more of the outer area of the volume of the support structure to the cushion structure 16 injected therein. If the windows 14 are few in number, there will be less surface area dedicated to the cushion structure 16. In the same manner, varying the size of the windows 14 will also vary the flexibility of the tool handle portion 10. The larger the window 14, the larger the cushion structure 16, which enhances flexibility. Generally, the greater the ratio of cushion structure 16 surface area to support structure 12 surface area, the more flexible the tool handle portion 10 will be once formed.

Separating windows 14 by ribs 23 of varying thicknesses will additionally vary the flexibility of the tool handle portion 10. For example, if the ribs 23 separating the windows 14 are relatively narrow, flexibility will increase, whereas widening or increasing a cross sectional area of the ribs will commensurately decrease flexibility of the tool handle portion 10.

FIGS. 2-9 represent a few of the myriad possibilities for configuring various embodiments of the instant invention. For example, turning to the embodiment illustrated in FIG. 2, the support structure 12 of the tool handle portion 10 includes the generally hollow, generally elliptical body 18, the top surface 20 and four longitudinal windows 14 that are separated at abutting ends 24 by relatively thin, transverse ribs 23 that are unitary with the body. The remaining circumferential borders of the windows 14 are surrounded by the body 18 of the support structure 12.

Figure 1:
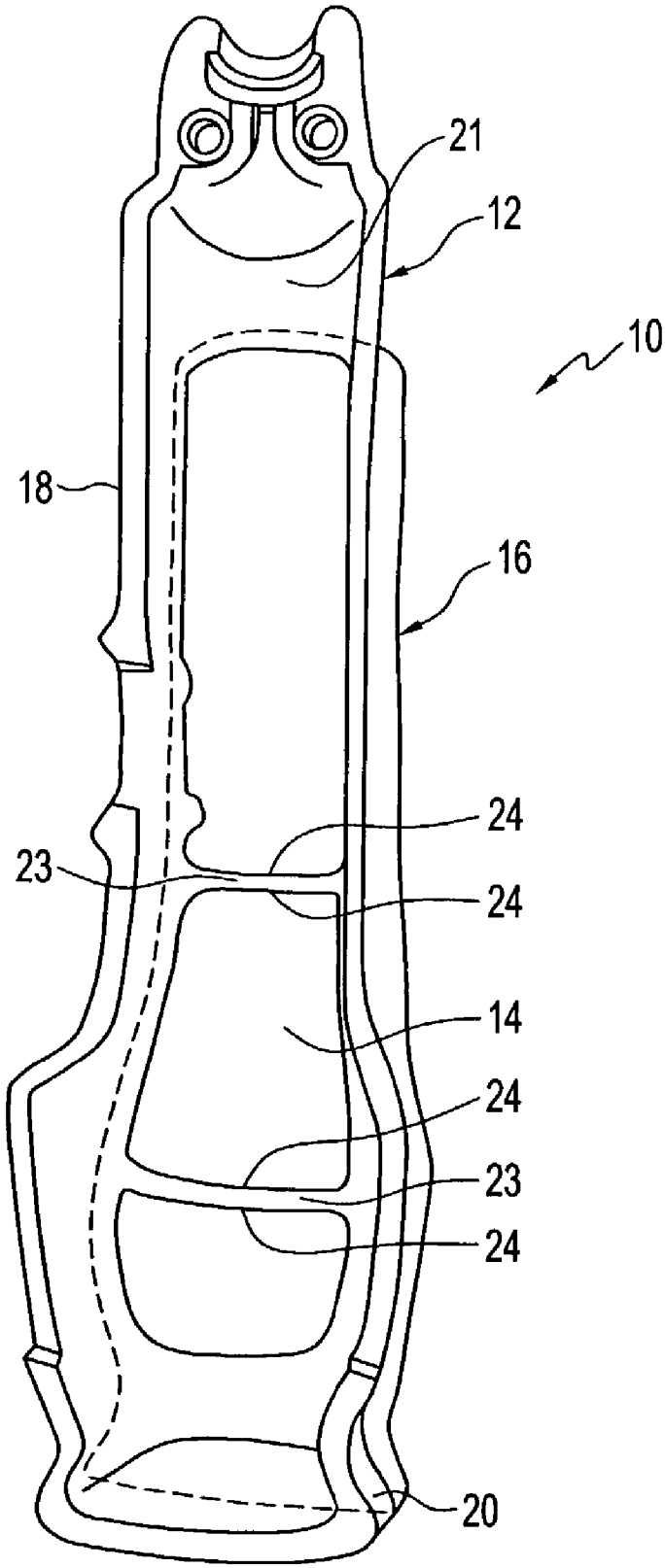
FIG. 1 is a side cut-away view of one embodiment of the tool handle portion of the instant invention.
Figure 2:
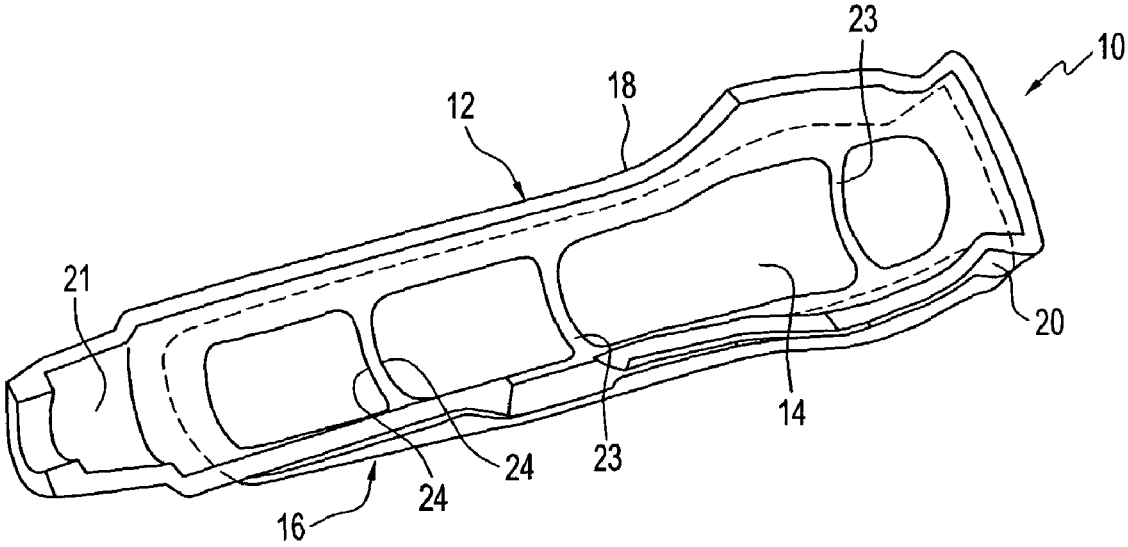
FIG. 2 is a side cut-away view of one embodiment of the tool handle portion of the instant invention.
Figure 3:
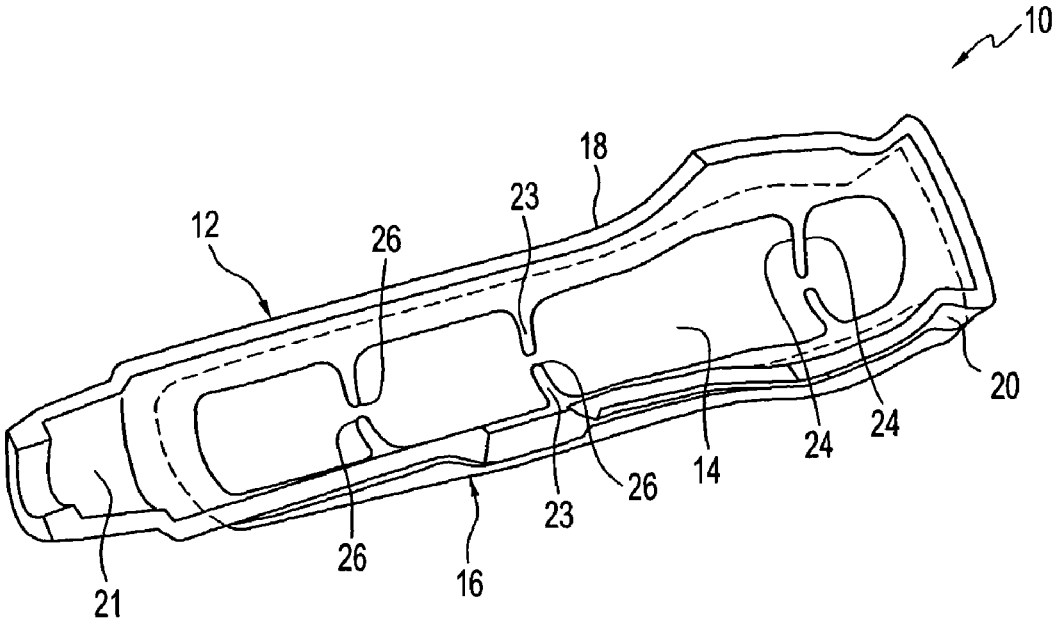
FIG. 3 is a side cut-away view of one embodiment of the tool handle portion of the instant invention.

FIG. 3 illustrates an embodiment wherein the ribs 23 extend only partially into the windows 14 in a transverse direction. Thus, the cushion structure 16 of the instant embodiment is continuous along at least a portion of the longitudinal length of the tool handle portion 10, and each rib 23 extends transversely into the windows 14 to oppose another rib at medial ends 26 of the ribs, separated by a relatively small portion of cushion structure. Because the ribs 23 do not separate the cushion structure 16 into discrete windows 14, the cushion structure in this embodiment is continuous along a portion of the longitudinal length of the tool handle portion 10. Owing to the continuity of the cushion structure 16 as well as the relatively thin ribs 23, the tool handle portion 10 illustrate in FIG. 3 would be relatively more flexible than the embodiment illustrated in FIG. 2.

Figure 4:
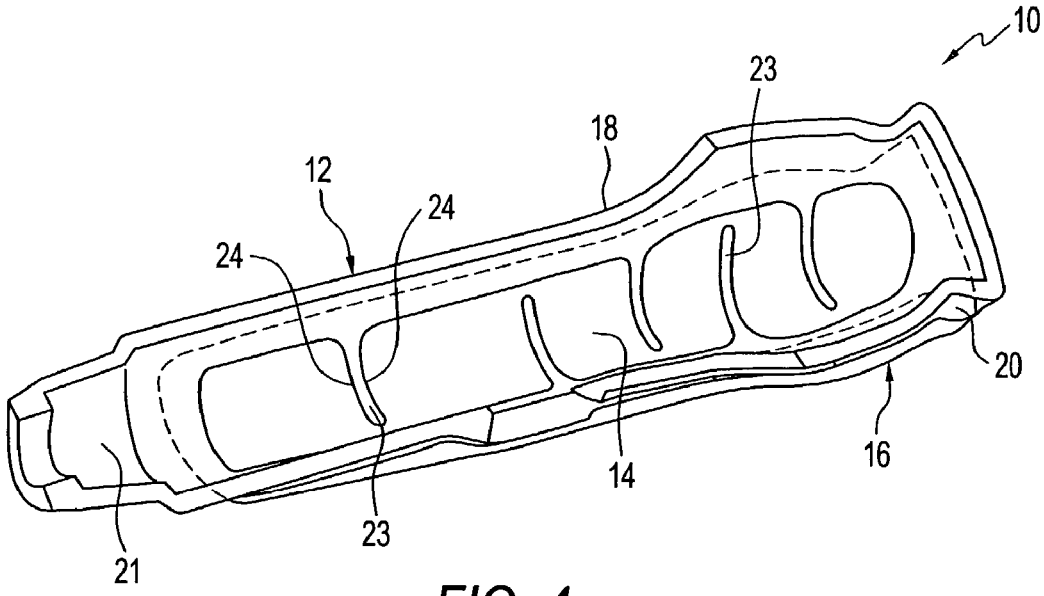
FIG. 4 is a side cut-away view of one embodiment of the tool handle portion of the instant invention.

The embodiment illustrated in FIG. 4 shows yet another possible configuration for the present tool handle portion 10, wherein the flexibility and cushioning properties of the tool handle portion may be varied by varying the configuration of the cushion structure 16 and the support structure 12. In FIG. 4, the cushion structure 16 extends in a generally longitudinal direction along the tool handle portion 10, and because ribs 23 do not extend across the entire width of the cushion structure, the windows 14 are not separated by a discrete boundary. Instead, there exists only one window 14 that is punctuated along its longitudinal length by transverse ribs 23 that extend from the support structure 12 into the cushion structure 16 in a transverse direction, alternating the direction from which the ribs extend from the support structure into the cushion structure. Because the ribs 23 do not oppose one another, and because the ribs only extend across a portion of the cushion structure 16, the tool handle portion 10 illustrated in FIG. 4 would be relatively more flexible than either embodiment illustrated in FIGS. 2 and 3.

Figure 5:
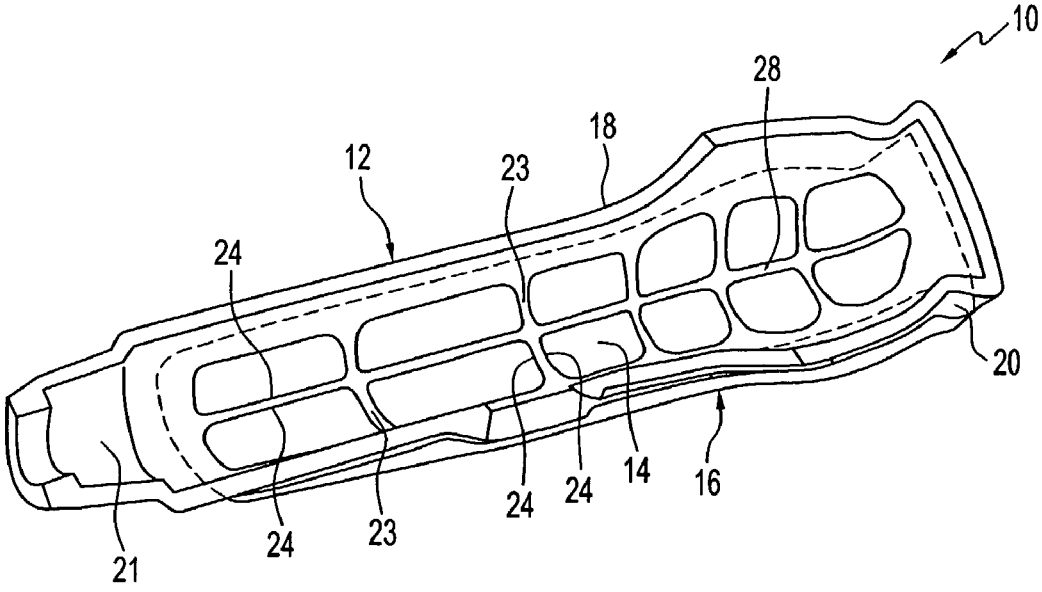
FIG. 5 is a side cut-away view of one embodiment of the tool handle portion of the instant invention.

FIG. 5 illustrates yet another embodiment wherein the cushion structure 16 is divided into windows 16 separated by portions of the support structure 12 that include a longitudinal rib 28 that is intersected at 10 locations along a periphery of the cushion structure by transverse ribs 23. The longitudinal rib 28 generally bisects the cushion structure 16, while the transverse ribs 23 extend outward from the support structure 12, and are both connected to and unitary with the longitudinal rib. Each transverse rib 23 extends toward an opposing transverse rib. In this manner, twelve windows 14 are created within the cushion structure 16, six on either side of the longitudinal rib 28, with opposing windows 14 on each side of the longitudinal rib being generally mirror images of one another. By including the longitudinal rib 28 as well as a plurality of transverse ribs 23, the embodiment illustrated in FIG. 5 would be relatively less flexible than the embodiments illustrated in FIGS. 2-4.

Figure 6:
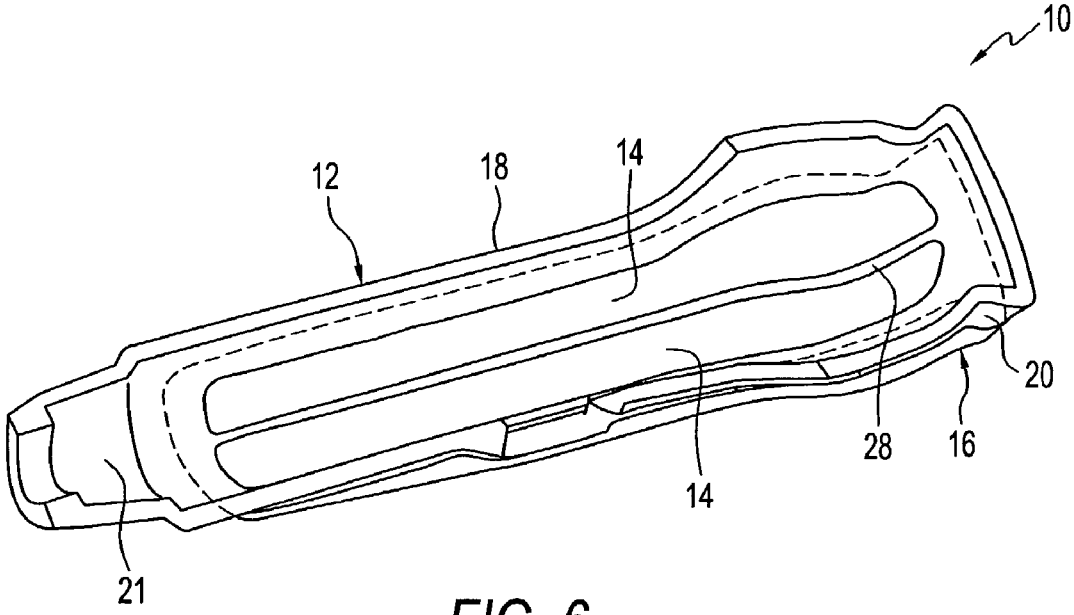
FIG. 6 is a side cut-away view of one embodiment of the tool handle portion of the instant invention.

Still another embodiment is illustrated in FIG. 6, wherein two longitudinal windows 14 are created by a longitudinal rib 28 that generally bisects the cushion structure 16. This embodiment lacks transverse ribs 23. Accordingly, this embodiment would be relatively flexible when compared to any of the previous embodiments illustrated in FIGS. 2-5.

Figure 7:
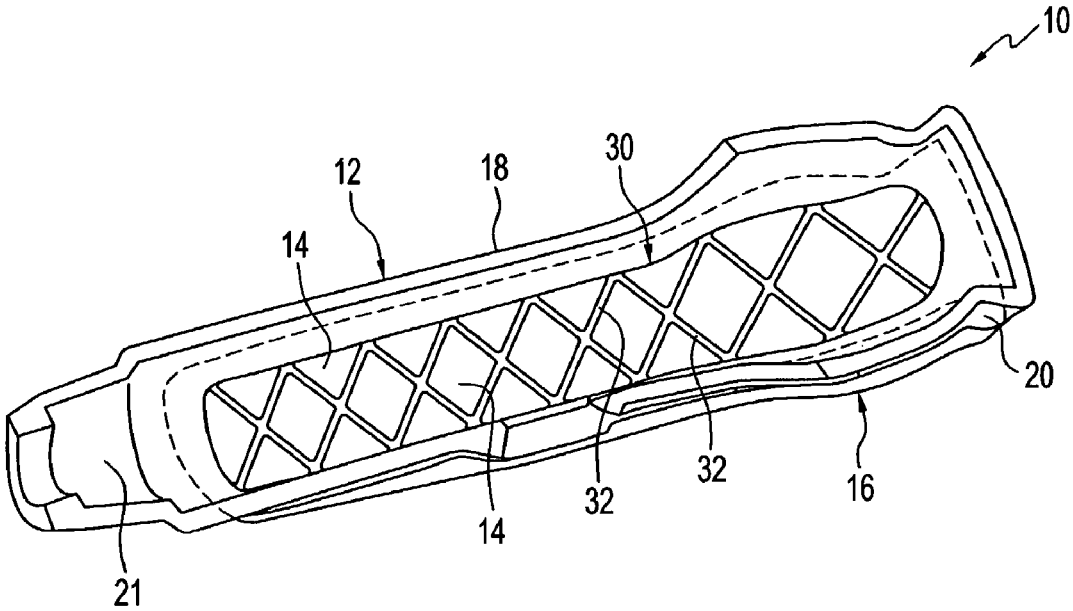
FIG. 7 is a side cut-away view of one embodiment of the tool handle portion of the instant invention.

Another possible configuration for the tool handle portion 10 of the instant invention is illustrated in FIG. 7, wherein the support structure 12 forms a lattice 30 across the cushion structure 16, resulting in a plurality of windows 14, for example 25, that are separated by diagonal ribs 32 crisscrossing the cushion structure. Because the support structure 12 intersects the cushion structure 16 so frequently, this embodiment would be relatively rigid when compared to any of the previous embodiments illustrated in FIGS. 2-6.

Figure 8:
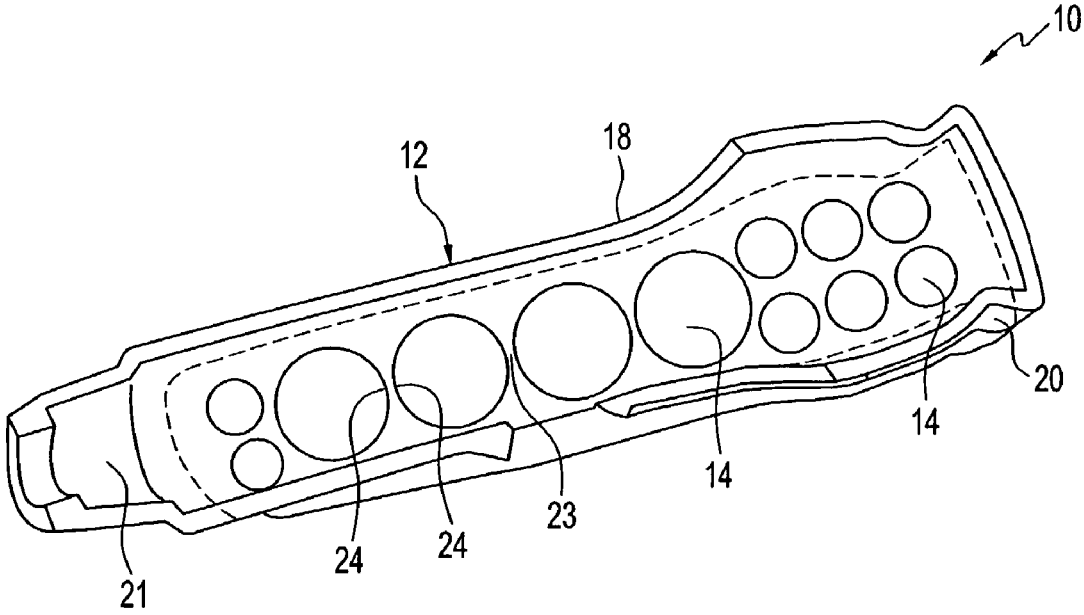
FIG. 8 is a side cut-away view of one embodiment of the tool handle portion of the instant invention.

FIG. 8 illustrates yet another embodiment of the present tool handle portion 10. In this embodiment, the windows 14 are generally circular, discrete units within the support structure 12, and are separated by portions of the support structure. The windows 14 are relatively numerous, but the support structure 12 separating each window is thicker than the ribs 23 previously illustrated. In this regard, the embodiment illustrated in FIG. 8 would be relatively rigid.

Figure 9:
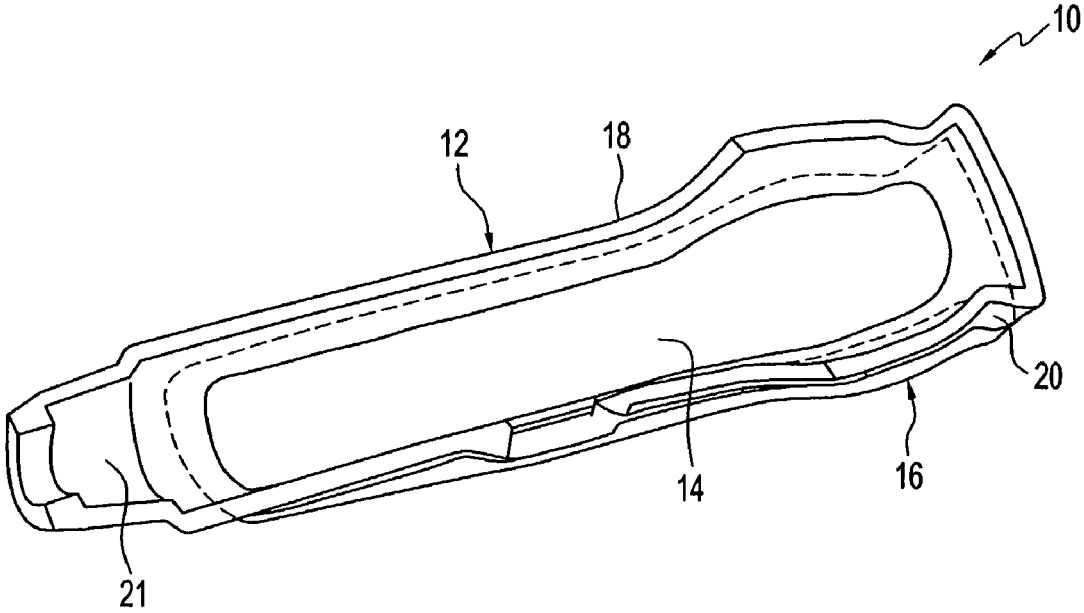
FIG. 9 is a side cut-away view of one embodiment of the tool handle portion of the instant invention.

Conversely, FIG. 9 illustrates a particularly simple embodiment of the instant invention, wherein the cushion structure 16 includes a single window 14 that extends in a longitudinal direction within the support structure 12. FIG. 9 therefore represents a very flexible embodiment of the instant invention, because it lacks any intrusion by the support structure 16 into the cushion structure 12.

The instant invention is contemplated for use with a variety of tools, and as such, is uniquely adaptable to applications requiring differing degrees of flexibility. For example, a hammer drill is used in applications such as drilling in concrete. As such, there is a large amount of linear vibration that is translated to the user's hands. In this instance, added cushion, comfort and flexibility is optimum. Thus, the tool handle portion 10 of the hammer drill might preferably be configured to maximize the cushion and flexibility of the cushion structure 16 by decreasing the size of the support structure 12, increasing the size of the cushion structure, minimizing the number of windows 14, decreasing the depth of the cushion structure, or a combination of each.

In contrast, a tool such as a circular saw disperses the vibrational forces in a multi-directional manner, thereby minimizing the vertical vibration in the user's hand. Accordingly, minimal cushion and flexibility is needed in this application, which can be achieved by configuring the tool handle portion 10 to have smaller and more numerous windows 14, increases the overall size of the support structure 12, increase the number of ribs 23 intersecting the cushion structure 16, decreasing the overall size of the cushion structure, increasing the depth of the cushion structure, or a combination of each.

Figure 15:
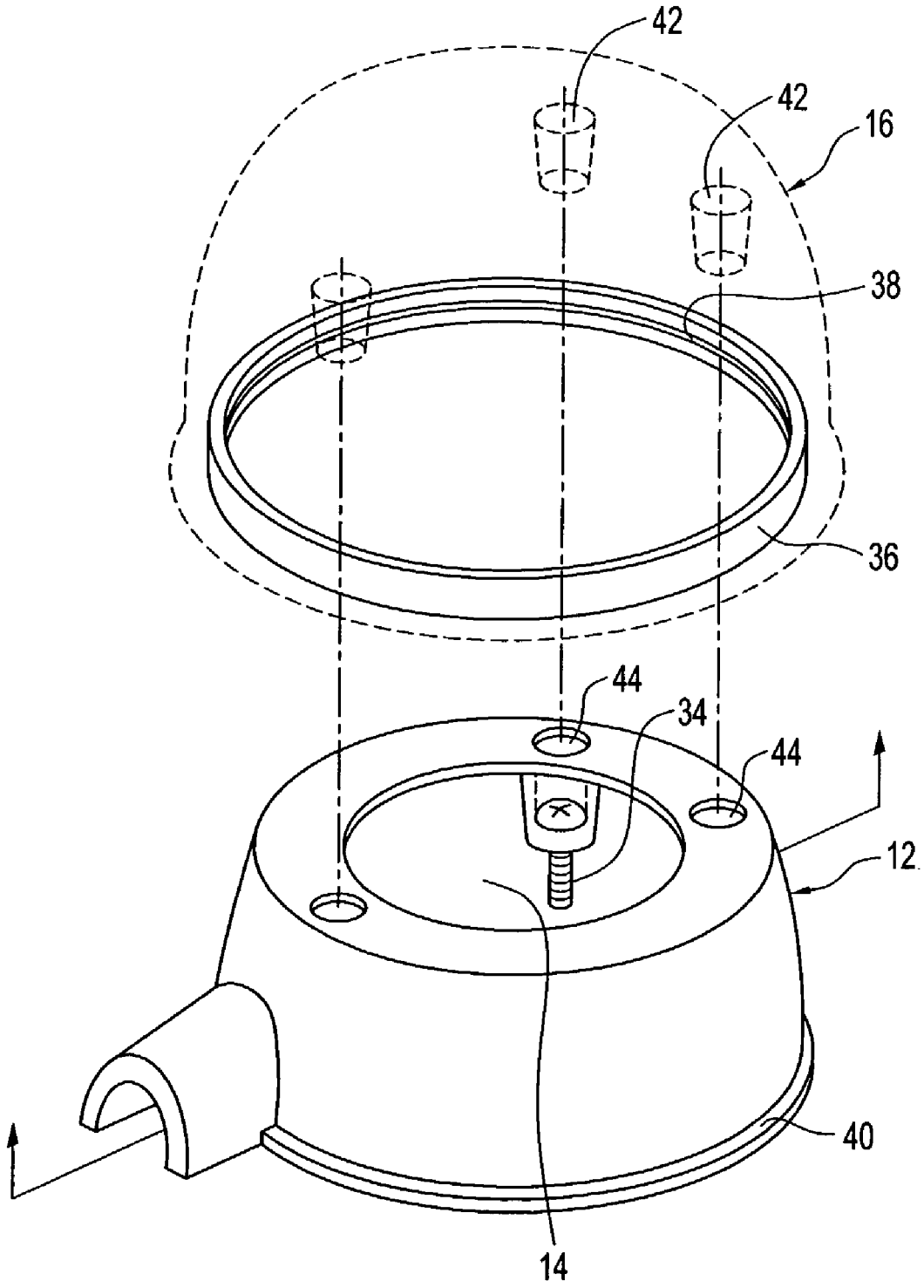
FIG. 15 is an exploded perspective view of an alternative embodiment of the handle portion of the instant invention.
Figure 16:
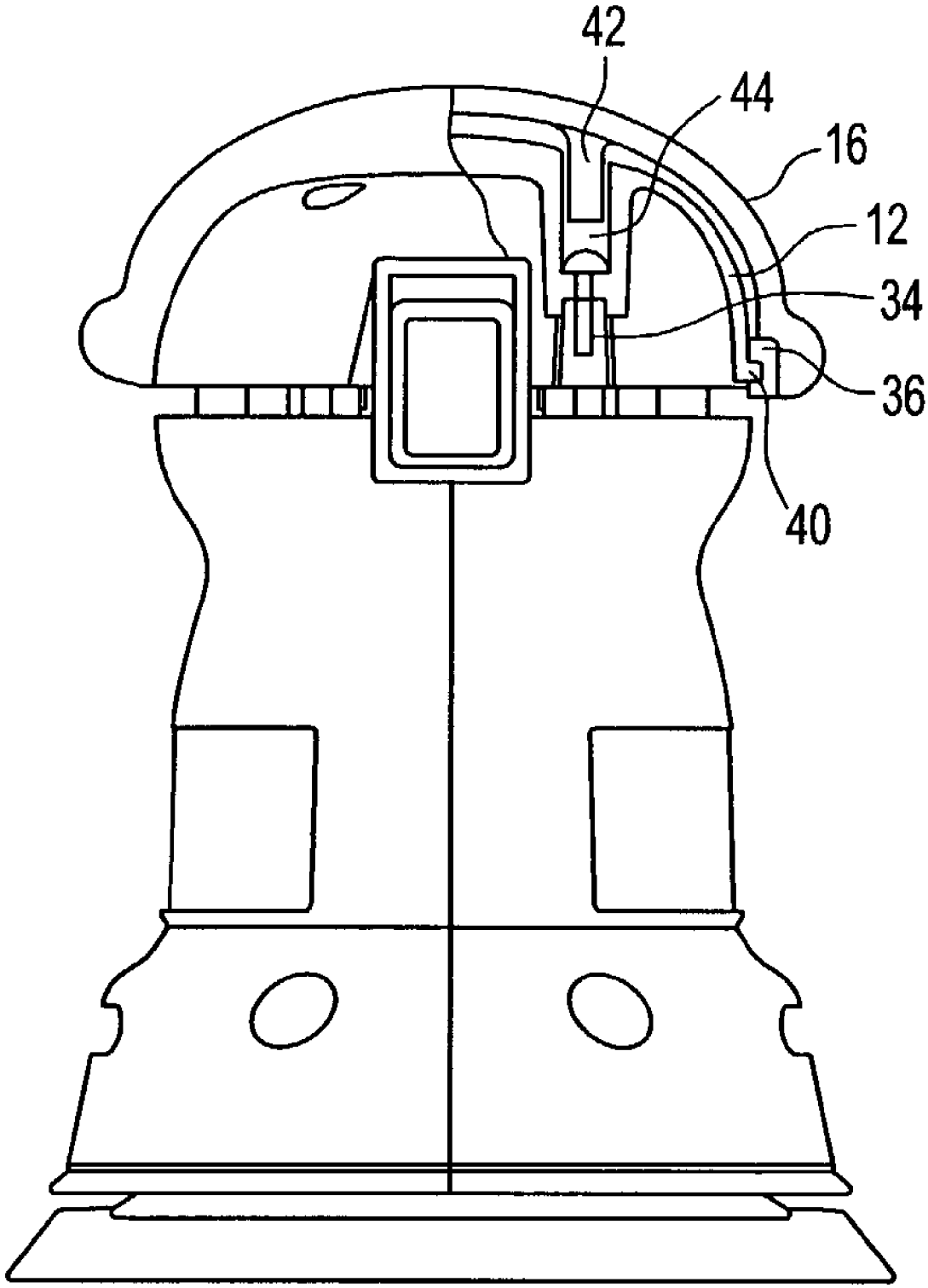
FIG. 16 is a cross-section of the embodiment illustrated in FIG. 15.

FIGS. 15 and 16 illustrate yet another embodiment of the instant invention, wherein the cushion structure 16 is selectively removable from the support structure 12, which is affixed to the hand tool via a threaded fastener 34 or adhesive, for example. As in the previous embodiments, the support structure 12 includes at least one window located adjacent to a predetermined portion around which the user's hand can grip. However, unlike the previous embodiments, the cushion structure 16 is not bonded therein, but is instead configured to selectively engage or disengage the support structure 12.

For example, in the embodiments illustrated in FIGS. 15 and 16, the cushion structure 16 may include a second support structure 36 that is disposed on or within the cushion structure. While it is contemplated that the second support structure 36 may assume a variety of configurations to suit individual applications, FIG. 15 illustrates the second support structure to be an annular ring disposed around a lower circumference of the cushion structure 16. While serving to provide additional support to the cushion structure 16, the second support structure 36 may also be configured to matingly engage the support structure 12, thereby mechanically attaching the cushion structure 16 to the support structure. For example, the second support structure 36 may include an annular recess 38 along an internal circumference thereof, while the support structure 12 includes an annular flange 40 disposed around a lower circumference of the support structure. Thus, when the cushion structure 16 is brought into engagement with the support structure 12, the annular recess 38 of the second support structure 36 matingly engages the annular flange 40 of the support structure to lockingly engage the cushion structure to the support structure.

Additionally, the cushion structure 12 may optionally be configured to envelop the second support structure 36. Thus, the cushion structure 16 itself may be configured to engage the support structure 12. In an embodiment wherein the cushion structure 16 envelopes the second support structure 36, the removable cushion structure 16 would prevent the second support structure from directly contacting the support structure 12, which further insulates the tool handle 10 from vibrational forces.

However, while FIG. 15 illustrates a second support structure 16, the instant embodiment contemplates a selectively removable cushion structure that lacks the second support structure 36 altogether. For example, the cushion structure 16 itself may include an annular recess (not shown) to engage the annular flange 40 of the support structure 12. Additionally, the cushion structure 16 may be sized and configured to engage the support structure 12 in a snap-fit engagement, a frictional engagement, or other engagement.

To promote proper alignment and engagement of the cushion structure 16 over the support structure 12, the cushion structure may include at least one locator pin 42 while the support structure may include a corresponding locator recess 44 that is sized and configured to receive the at least one locator pin. To enhance alignment, the support structure 12 and cushion structure 16 may optionally include a plurality of locator recesses 44 and locator pins 42, respectively. Thus, the predetermined configuration of the locator pins 42 and locator recesses 44 further promotes predetermined alignment of the cushion structure 16 with the support structure 12 as the two structures matingly engage one another.

While a particular embodiment of the present cushion grip handle has been described herein, it will be appreciated by those skilled in the art that changes and modifications may be made thereto without departing from the invention in its broader aspects and as set forth in the following claims.

What is claimed is:

1. A tactile handle of the type configured for gripping by a human hand comprising:

an outer skeletal support structure having a predetermined hollow center configuration, said skeletal support structure including a plurality of windows separated by a plurality of ribs, wherein each of said plurality of ribs have a width that is less than a diameter of a largest circle that would fit within any of said plurality of windows, said plurality of ribs having an inside surface generally defining said hollow center and an outside surface generally coextensive with and defining the outside of said skeletal support structure, wherein said plurality of windows is spread throughout substantially the entire length of said skeletal support structure, wherein each of said plurality of windows entirely penetrates said skeletal support structure; and a cushion structure injection molded within each of said plurality of windows with the cushion structure being only chemically bonded to the skeletal support structure where the cushion structure contacts the support structure, said cushion structure covering substantially the entire skeletal support structure, said cushion structure spanning said plurality of windows but not extending generally beyond said inside surface of said ribs into said hollow center.

2. A handle portion of a hand tool housing of the type that is ergonomically configured for normal gripping by the hand of a user and wherein the pressure points of contact by at least one predetermined portion of the hand principally contact a relatively soft tactile cushion surface, comprising:

an outer skeletal support structure configured to provide a volume around which the user's hand can grip with the user's thumb, palm and fingers and having a predetermined hollow center configuration and including a plurality of windows separated by a plurality of ribs, wherein each of said plurality of ribs have a width that is less than a diameter of a largest circle that would fit within any of said plurality of windows, said plurality of ribs having an inside surface generally defining said hollow center and an outside surface generally coextensive with and defining the outside of said skeletal support structure, wherein said plurality of windows is spread throughout substantially the entire length of said skeletal support structure, wherein each of said plurality of windows entirely penetrates said skeletal support structure;

an outer layer of microcellular material formed into a cushion structure by injection molding within said plurality of windows, wherein said cushion structure is only chemically bonded to said skeletal support structure where it contacts said skeletal support structure and said cushion structure covers substantially the entire skeletal support structure and spans said plurality of windows to provide said relatively soft tactile cushion surface, said cushion structure not extending generally beyond said inside surface of said skeletal support structure into said hollow center.

3. The handle portion as defined in claim 2 further comprising two skeletal support structures that fit together in a complimentary manner to form the single handle portion.

4. The handle portion of claim 2 wherein said support structure comprises a material that will bond to said cushion structure.

5. The handle portion of claim 2 wherein said support structure comprises nylon.

6. The handle portion of claim 5 wherein said cushion structure comprises a thermal plastic elastomer.

7. The handle portion of claim 2 wherein said support structure comprises urethane.

8. The handle portion of claim 7 wherein said cushion structure comprises urethane.

9. The handle portion of claim 2 wherein said cushion structure has a predetermined thickness.

10. The handle portion of claim 2 wherein said cushion structure has a predetermined non-uniform thickness.

11. The handle portion of claim 2 wherein said plurality of windows has a predetermined configuration.

12. A method of making a tactile handle having cushioning characteristics configured for gripping by a human hand comprising:

selecting a first composite material;

forming an outer skeletal support structure configured to provide a volume around which the user's hand can grip with the user's thumb, palm and fingers and having a predetermined hollow center configuration and including a plurality of windows separated by a plurality of ribs, wherein each of said plurality of ribs have a width that is less than a diameter of a largest circle that would fit within any of said plurality of windows, said plurality of ribs having an inside surface generally defining said hollow center and an outside surface generally coextensive with and defining the outside of said skeletal support structure, wherein said plurality of windows is spread throughout substantially the entire length of said skeletal support structure, wherein each of said plurality of windows entirely penetrates said skeletal support structure;

selecting a second composite material capable of adhering to said first material; and injection molding a cushion structure made from the second composite material principally within said plurality of windows of the skeletal support structure to form a cushion structure that is only chemically bonded to the outside surface of said support structure where said cushion structure contacts said skeletal support structure, wherein said cushion structure covers substantially the entire skeletal support structure, said cushion structure spans said plurality of windows but does not extend generally beyond the inside surface of said support structure into said hollow center.

13. A method for varying the tactile characteristics of a handle portion of a power hand tool configured for normal gripping in the hand of a user comprising:

forming an outer skeletal support structure that imparts the structural strength of the handle portion and having an outer configuration defining an overall shape of the handle portion with a hollow center, said skeletal support structure having an inside surface generally defining said hollow center and an outside surface, said outer configuration having relatively firm tactile surface portions, said outer skeletal support structure having a predetermined hollow center configuration, said skeletal support structure including a plurality of windows separated by a plurality of ribs, wherein each of said plurality of ribs have a width that is less than a diameter of a largest circle that would fit within any of said plurality of windows, said plurality of ribs having an inside surface generally defining said hollow center and an outside surface generally coextensive with and defining the outside of said skeletal support structure, wherein said plurality of windows is spread throughout substantially the entire length of said skeletal support structure, wherein each of said plurality of windows entirely penetrates said skeletal support structure;

said skeletal support structure being sized and configured to be adjacent pressure points of the user's hand when the user is gripping the handle portion in a normal manner; and molding a cushion structure to said skeletal support structure whereby said cushion structure is only chemically bonded to said support structure where it is in contact therewith, said cushion structure covering substantially the entire skeletal support structure, said cushion structure spanning the plurality of windows of said skeletal support structure and being at least partially disposed within said windows to impart a soft tactile surface in said windows, said cushion structure not extending generally beyond said inside surface of said support structure into said hollow center.

14. The method of claim 13 wherein said step of forming the skeletal support structure comprises forming a greater number of windows in the support structure to increase flexibility.

15. The method of claim 13 wherein said step of forming the skeletal support structure comprises forming a fewer number of windows to decrease flexibility.

16. The method of claim 13 wherein said step of forming the skeletal support structure comprises forming the plurality of windows to be either larger to impart greater flexibility or smaller to impart less flexibility.

17. The method of claim 13 wherein said plurality of ribs are formed to be relatively thick to impart less flexibility or relatively thin to impart greater flexibility.

18. The method of claim 13 wherein said step of molding the cushion structure includes determining a thickness of the cushion structure commensurate with the desired degree of flexibility.

19. The method of claim 18 wherein said step of determining the thickness of the cushion structure includes forming a relatively thicker cushion structure for less flexibility or forming a relatively thinner cushion structure for greater flexibility.

20. The method of claim 18 wherein said step of determining the thickness of the cushion structure includes molding local areas of the cushion structure that are thicker than other areas of the cushion structure.

* * * * *